US009291004B2

(12) United States Patent
David et al.

(10) Patent No.: US 9,291,004 B2
(45) Date of Patent: Mar. 22, 2016

(54) TUBULAR DRILL STRING COMPONENT AND CORRESPONDING DRILL STRING

(75) Inventors: Didier David, Ruesnes (FR); Gérard Leveau, Saint Aubin des Hayes (FR); Gabriel Roussie, Valenciennes (FR)

(73) Assignee: VALLOUREC DRILLING PRODUCTS FRANCE, Cosne-Cours-sur-Loire (FR)

( * ) Notice: Subject to any disclaimer, the term of this patent is extended or adjusted under 35 U.S.C. 154(b) by 859 days.

(21) Appl. No.: 13/143,119

(22) PCT Filed: Jan. 4, 2010

(86) PCT No.: PCT/FR2010/000001

§ 371 (c)(1),
(2), (4) Date: Jul. 29, 2011

(87) PCT Pub. No.: WO2010/079283

PCT Pub. Date: Jul. 15, 2010

(65) Prior Publication Data

US 2011/0290475 A1 Dec. 1, 2011

(30) Foreign Application Priority Data

Jan. 6, 2009 (FR) ..... 09 00019

(51) Int. Cl.
*E21B 17/02* (2006.01)

(52) U.S. Cl.
CPC ..... *E21B 17/023* (2013.01)

(58) Field of Classification Search
None
See application file for complete search history.

(56) References Cited

U.S. PATENT DOCUMENTS

| | | | | |
|---|---|---|---|---|
| 2,414,719 | A | 1/1947 | Cloud | |
| 4,493,140 | A | 1/1985 | Abdullaev et al. | |
| 6,145,597 | A | 11/2000 | Kobylinski | |
| 7,201,240 | B2 * | 4/2007 | Hall et al. | 175/320 |
| 7,644,755 | B2 * | 1/2010 | Stoesz et al. | 166/65.1 |
| 8,118,093 | B2 * | 2/2012 | Hassell et al. | 166/242.6 |
| 8,208,777 | B2 * | 6/2012 | Braden et al. | 385/131 |
| 8,344,905 | B2 * | 1/2013 | Madhavan et al. | 340/855.1 |

FOREIGN PATENT DOCUMENTS

| | | |
|---|---|---|
| FR | 2 119 266 | 8/1972 |
| GB | 2 336 886 | 11/1999 |

OTHER PUBLICATIONS

U.S. Appl. No. 13/259,735, filed Sep. 23, 2011, Leveau, et al.
International Search Report Issued Mar. 30, 2010 in PCT/FR10/000001 filed Jan. 4, 2010.
U.S. Appl. No. 13/821,462, filed Mar. 7, 2013, Chabas, et al.
U.S. Appl. No. 13/822,136, filed Mar. 11, 2013, Chabas, et al.

* cited by examiner

*Primary Examiner* — Jennifer H Gay
*Assistant Examiner* — Caroline Butcher
(74) *Attorney, Agent, or Firm* — Oblon, McClelland, Maier & Neustadt, L.L.P.

(57) ABSTRACT

Tubular drill string component for drilling a hole with circulation of a drilling fluid around the component and in a direction going from a drill hole bottom to the surface. The component includes a first end including a female threading, a second end including a male threading, and a substantially tubular central zone. The component includes a communication tube arranged at least in the central zone and in contact with a bore of the central zone. A signal transmission cable is arranged in the tube. The communication tube includes a body formed from at least one metal strip arranged with an annular component. The body includes, in section along a plane passing through the axis of the tube, at least two axially elongated lengths, partially overlapping one another with an axial play selected to accommodate the maximum elastic deformation of the component under axial compressive and/or bending stress.

19 Claims, 1 Drawing Sheet

TUBULAR DRILL STRING COMPONENT AND CORRESPONDING DRILL STRING

BACKGROUND OF THE INVENTION

1. Field of the Invention

The invention falls within the field of the search for and the mining of oil or gas deposits in which use is made of rotating drill strings consisting of tubular components such as standard and if appropriate heavyweight drillpipes and other tubular elements, in particular drill collars in the region of the bottom hole assembly, connected end-to-end, in accordance with the requirements of the drilling.

The invention relates more particularly to a profiled element for a rotatory drilling outfit, such as a standard or heavyweight pipe or a drill collar, arranged in the body of a rotating drill pipe section.

2. Description of the Related Art

Drill strings of this type can allow in particular directional drilling to be carried out, i.e. drilling, the inclination of which relative to the vertical or the azimuth direction can be varied during the drilling. Directional drilling can nowadays reach depths of the order of 2 to 4 km and horizontal distances of the order of 2 to 14 km.

In the case of directional drilling of this type, comprising practically horizontal runs, the frictional torques due to the rotation of the drill pipe sections in the well can reach very high values over the course of the drilling. The frictional torques can compromise the equipment used or the objectives of the drilling. The frictional torques may thus be such that they make it impossible to continue drilling.

In order to better understand the events which occur at the bottom of the hole, the bottom hole assemblies, close to the drill bit, can be provided with measuring instruments. However, knowledge of the occurrences in the hole remains very patchy.

Pipes have been provided with data transmission systems with an electromagnetic loop at each end of the pipe and a wire connection between the electromagnetic loops in order to retrieve the data provided by the measuring instruments. The wire connection can be provided in the thickness of the wall of the tube forming the central part of the pipe. However, as the wall of the tube is itself as thin as possible for reasons of mass, costs and internal diameter, a longitudinal hole formed in the wall can weaken the tube excessively. Moreover, the machining of a hole of this type is difficult and relatively expensive.

Alternatively, the wire connection can be arranged in the bore of a drillpipe. The wire connection must then be protected against the wear caused by the circulation of the drilling mud inside the pipe or against the deformations resulting from the pressure of the mud or resulting from the axial loading to which the pipe can be subjected (traction, compression, bending). Various solutions have been proposed: a coaxial cable tensioned in the region of its ends, a cable placed between the bore of the drillpipe and a tubular liner pressed against the bore. The applicant has found over the course of its research that these various solutions all had drawbacks, for example that they could significantly reduce the flow section and therefore increase the losses of pressure or else be complex to carry out.

BRIEF SUMMARY OF THE INVENTION

The invention helps to improve the situation.

A tubular drill string component for drilling a hole with circulation of a pressurised drilling fluid inside said component comprises a first end comprising a female threading, a second end comprising a male threading, and a substantially tubular central zone, in particular having an external diameter smaller than or equal to the external diameter of at least the first or the second end. The component comprises a communication tube arranged at least in the central zone and in contact with a bore of the central zone. The component typically includes at least one signal transmission cable (also called communication cable) arranged within the communication tube. The communication tube comprises a body formed from at least one metal strip arranged with an annular component. The body comprises, in section along a plane passing through the axis of the tube, at least two axially elongated lengths, partially overlapping one another with an axial play selected to accommodate the maximum elastic deformation of the component under axial compressive and/or bending stress. The axial play is selected so that the elastic deformations of the component, which is typically made of steel, are only weakly transmitted to the metallic strip. This can be achieved even with very small plays, that is to say plays that are typically comprised between a few hundreds of centimeters (i.e., typically between 0.03 and 0.2 mm) for narrow strips (i.e., typically between 2 and 5 mm wide) and a few tenths of millimeters (i.e., typically between 0.3 and 2 mm) for strips a few tens of millimeter wide (i.e., typically between 20 and 50 mm).

A drill string can comprise a drill pipe section and a bottom hole assembly, the bottom hole assembly being provided with a drill bit. The drill pipe section is arranged between the bottom hole assembly and a member for driving the drill string. The drill pipe section comprises tubular components for drilling with circulation of a pressurised drilling fluid inside said component. The drilling fluid typically moves down within the component and back up outside the component, in a direction going from the bottom of a drilling hole to the top of the same, thus creating a circulation around the component. The component comprises two ends respectively provided with a female threading and with a male threading. The component comprises a substantially tubular central zone, in particular having an external diameter which is smaller than or equal to the external diameter of at least one of the two ends, and a communication tube arranged at least in the central zone and in contact with a bore of said central zone.

The communication tube comprises a body formed from at least one metal strip arranged with an annular component. The body comprises, in section along a plane passing through the axis of the tube, at least two axially elongated lengths, partially overlapping one another with an axial play selected to accommodate the maximum elastic deformation of the component under axial compressive and/or bending stress.

The present invention will be better understood on reading the detailed description of a few embodiments taken by way of non-limiting examples and illustrated by the appended drawings, in which:

DETAILED DESCRIPTION OF THE INVENTION

Figure 1:
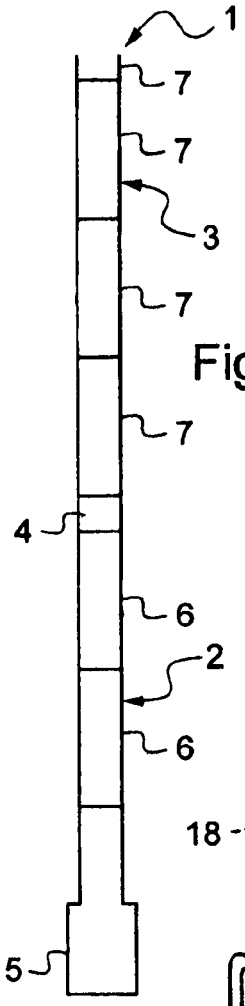
FIG. 1 is an elevation of a drill string.

During the digging of a well, a drill tower is arranged on the ground or on a platform in the sea for drilling a hole in the layers of the ground. A drill string is suspended in the hole and comprises a drilling tool such as a drill bit at its lower end. The drill string is driven in rotation by a drive mechanism activated by, for example hydraulic, means (not shown). The drive mechanism can comprise a kelly bar at the upper end of the drill string. The drill string is suspended from a hook attached to a travelling block via the bias of the kelly bar and a rotating head allowing the drill string to rotate relative to the hook. A drilling fluid or mud is stored in a tank. A mud pump sends drilling fluid inside the drill string through an orifice of the injection head, forcing the drilling fluid to flow downward through the drill string. The drilling fluid subsequently leaves the drill string through channels of the drill bit, then rises in the generally annular-shaped space formed between the outside of the drill string and the wall of the hole.

The drilling fluid lubricates the drilling tool and takes the drill cuttings cleared by the drill bit from the bottom of the hole to the surface. The drilling fluid is then filtered in order to be able to be reused.

The bottom hole assembly can comprise a drill bit and drill collars, the mass of which presses the drill bit against the bottom of the hole. The bottom hole assembly can also comprise sensors for measuring, for example, pressure, temperature, stress, inclination, resistivity, etc. Signals originating from the sensors can be brought to the surface by a cabled telemetry system. A plurality of magnetic couplers are interconnected inside the drill string in order to form a communication link. Reference may be made to U.S. Pat. No. 6,641,434, for example. The two ends of a drilling component are equipped with communication couplers. The two couplers of the component are connected by a cable, substantially over the length of the component.

The cable can be laid in a longitudinal hole formed in the thickness of the wall of the component. The thickness of the wall is locally reduced, hence a weakening of certain mechanical properties that can prove critical. The cable can also run in the bore of the drilling component in contact with the drilling fluid. The drilling mud moving under high pressure may cause rapid wear to the cable, hence a short lifetime and high maintenance costs. The mud is also likely to damage the cable as a result of the pressure that it exerts on said cable. The cable can be arranged in the bore of the drilling component under special protection, but the types of protection in question have drawbacks. Such types of cable and protection are described, in particular, in documents U.S. Pat. No. 6,641,434, U.S. Pat. No. 6,670,880, U.S. Pat. No. 6,717,501, US 20050115717 or else US 20060225926.

U.S. Pat. No. 6,717,501 describes a wire connection in the form of a coaxial cable, the central part of which is protected by a sheath which is made of PEEK®-type organic material and can be glued to the bore of the pipe.

Application US 20060225926 proposes placing a wire connection between the bore of the drillpipe and a cylindrical tubular liner stuck to the bore of the pipe by hydroforming. However, this solution requires a fairly heavy and therefore expensive technology to be used. It also reduces the section of the bore of the pipe and causes during operation an increase in the losses of the pressure and therefore a reduction in the flow rate of the drilling muds and the rate at which the hole is dug, for a given mud-pumping installation; this results in an increase in costs.

Application US 20050115717 also provides a wire connection placed between the bore of the drillpipe and a liner obtained from a foil, the width of which is larger than the perimeter of the bore of the pipe, curved and stuck resiliently to the bore of the pipe. However, the foil formed as a liner reduces the section of the bore of the pipe, resulting in an increase in costs.

The invention seeks in particular to propose a drilling component allowing signals to be transmitted between two end couplers preserving a high through-section and preserving the integrity of the least thick parts of the wall of the component while at the same time providing suitable protection to the communication cable. The end couplers can be of any type (for example, magnetic, inductive, or electrical, or any combination thereof, such as an electromagnetic coupler).

Furthermore, the Applicant has found over the course of its research that the protection around the communication cable arranged in the bore of the component was likely to break not only under the effect of abrasion of the drilling mud, but also under the effect of displacement, in particular during elongation and during bending of the component itself. During drilling operations, a component has to withstand the entire weight of all of the components situated at a lower level. The same applies as the drill string rises: traction is then exerted on the entire drill string from the surface. The tubular component can then be elongated under the tensile stress, hence a risk of breaking the protection surrounding the communication cable. The risk of breakage also occurs during bending of the drilling component, for example under the stress of directional drilling, of S-shaped drilling portions (dog-legs) in order to avoid certain formations, etc., the bending resulting in the parts situated in the extrados being placed under tensile stress.

The component can be subjected to axial compressive stresses, for example in the region of the drill collars which rest on the drill bit or in the intrados portions of pipes subjected to bending. It is therefore necessary to tensile-prestress the cable in order to prevent the cable from protruding in the bore of the pipe subjected to compressive stress; however, there is then a risk that the cable will break during tensile loading. This is in particular what occurs over the course of directional rotary drilling, the generatrices of the component then passing alternately from the intrados to the extrados, and the cyclic character heightens the risks of breakage (fatigue caused by rotary bending). The gluing of the cable to the bore does not solve the problem as the glue soon cracks under cyclic loading.

Application US 20050092499 proposes a coaxial cable which is crimped by stretching in a metal tubular protective sheath arranged in a helical arrangement and stuck to the inner bore of the pipe by axial compressive stress acting on its ends. However, the sheathed cable according to this document displays marked changes in direction at the locations where the sheath enters the wall of the component; this also creates risks of the sheath and the cable breaking under cyclic rotary bending loads.

As is illustrated in FIG. 1, a drill string 1 comprises a bottom hole assembly 2 and a drill pipe section 3. The bottom hole assembly 2 and the drill pipe section 3 are for example connected by a connector element 4. The bottom hole assembly 2 can comprise a drill bit 5 and one or more drill collars 6. As a result of its/their high mass, the drill collar or drill collars 6 ensure the contact of the drill bit 5 against the bottom of the hole. The drill pipe section 3 comprises a plurality of pipes 7 which can comprise standard pipes obtained by connection by welding of a male end, a great-length tube and a female end on the side opposite to the male end in order to form by connection tight threaded tubular connections provided with metal sealing surfaces and if appropriate heavyweight pipes. A pipe may be of the type according to specification API 7 of the American Petroleum Institute or according to designs peculiar to the manufacturers, for example with ends illustrated by documents U.S. Pat. No. 6,513,840 or U.S. Pat. No. 7,210,710, which the reader is invited to refer to.

The drill string 1 can also be equipped with sensors. More specifically, the bottom hole assembly can be provided with components 30 provided with pressure, temperature, mechanical stress, inclination, resistivity, etc. sensors. Other elements of the drill string 1, for example one or more drill collars 6, one or more pipes 7, can also be provided with measuring sensors. The transmission of information between the sensors and the surface requires a high data rate, which a wireless transmission by pressure pulses in the mud cannot provide, and in real time, which a memory storage close to the sensor or sensors cannot provide. Document FR 2 883 915 describes a pipe provided with an expansible tubular lining sleeve. A cable is arranged in a sole plate provided between the lining sleeve and the bore and is connected at each end to one inductive coupler designed to transmit a signal to another inductive coupler of another pipe connected to the first.

The invention seeks to provide a drilling element, in particular a pipe, a heavyweight pipe, a drill collar, etc. provided with a communication cable protected against the drilling mud circulating inside the pipe and likely to accompany the deformations of the pipe while preserving the integrity of the cable and the protection.

Figure 2:
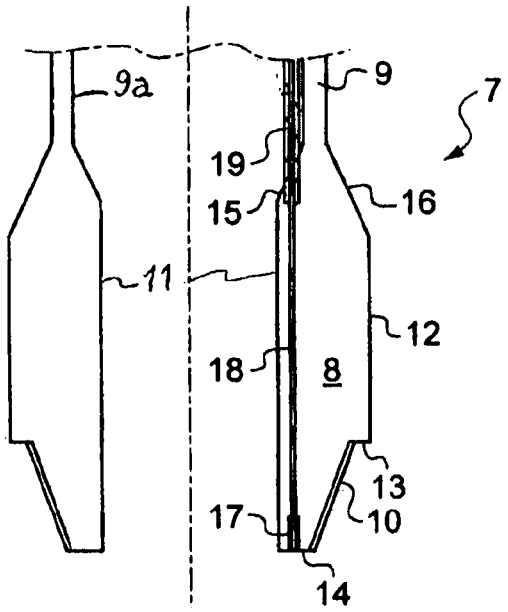
FIG. 2 is an elevation of a drilling component.

As may be seen from FIG. 2, a pipe 7 comprises a male end 8 and a tubular body 9. The tubular body 9 can be connected on the side remote from a female end (not shown). The male end 8 and the tubular body 9 can be welded, in particular by friction. The male end 8 comprises a male threading 10 formed on a, for example substantially frustoconical, outer surface. The male end 8 also comprises a bore 11, an outer surface 12, a, for example substantially radial, shoulder 13 between the male threading and the outer surface 12 and a, for example substantially radial, outer surface 14. The bore 11 and the outer surface 12 can have cylindrical shapes generated by revolution and be concentric. The male end 8 is connected to the tubular body 9 by a substantially frustoconical inner surface 15 and a substantially frustoconical outer surface 16. The bore 9*a* of the tubular body 9 has in this case (in the case of a standard drillpipe) a diameter larger than the diameter of the bore 11. The external diameter of the tubular body 9 is in this case smaller than the diameter of the outer surface 12 of the male end 8. The situation may be different for the outer surface and bore diameters in the case of heavyweight pipes or drill collars.

The pipe 7 also comprises a coupler 17 that, in the example embodiment of FIG. 2 is an inductive coupler, is arranged in an annular groove formed in the male end 8 from the end surface 14. The annular groove can have an overall rectangular section with a depth in the direction of the axis of pipe which is larger than its width in the radial direction. The inductive coupler 17 is connected to a communication cable 18 extending over the length of the pipe 7 of the inductive coupler 17 to another inductive coupler arranged on the side of the female end. The communication cable 18 passes into a hole parallel to the axis and passing substantially through the length of the male end 8. Optionally, the through-hole of the communication cable 18 can display a slight inclination, for example relative to a plane passing through the axis. The through-hole of the communication cable 18 emerges on one side in the bottom of the groove forming a recess for the inductive coupler 17 and emerges on the other side in the connection surface 15 between the male end 8 and the tubular body 9. The communication cable 18 can thus be connected to the inductive coupler 17 in the bottom of the groove accommodating said inductive coupler 17 and is protected against the drilling mud circulating in the bore of the pipe 7 through the material thickness of the male end 8. The pipe 7 comprises a communication tube 19 surrounding the communication cable 18 in the zone of the tubular body 9. The communication tube 19 may be in contact with the bore 9*a* of the tubular body 9. The communication tube 19 can be fixed, for example, by fitting in a widened zone of the through-hole of the communication cable 18 in the vicinity of the connection surface 15. The communication tube 19 can have an end fitted in the through-hole of the communication cable 18, an opposite end fitted in the corresponding hole of the female end of the pipe 7 and a common part in the bore of the tubular body 9.

Figure 3:
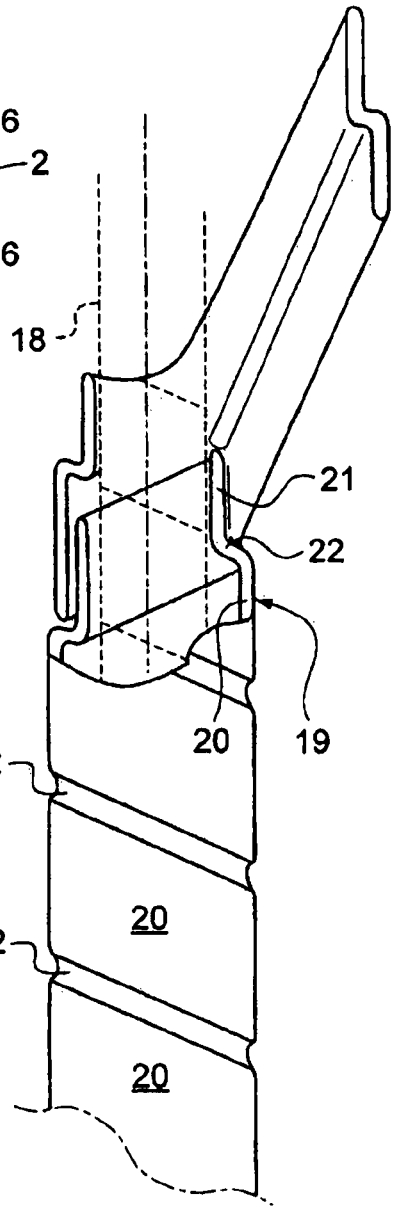
FIG. 3 is a view of a communication tube, in axial section for the central part, in side elevation for the lower part of the figure.

As illustrated in FIG. 3, the communication tube 19 is in the form of a strip arranged in a helical arrangement surrounding the communication cable 18. The strip is basically metallic, for example made of E235-type mild steel according to Euronorm or of AISI 304L-type austenitic stainless steel, and is typically shaped. The strip comprises, in section along a plane passing through the axis of the tube, an axially elongated large-diameter part 20 and an axially elongated small-diameter part 21. The large-diameter part 20 of one length surrounds a small-diameter part 21 of a neighbouring length. The notion of the length of the communication tube 19 appears on the part represented in section along an axial plane, even though the communication tube can be formed from a single strip arranged in a spiral arrangement. In other words, the large-diameter part 20 of a length of rank N surrounds the small-diameter part 21 of a length of rank N−1. The small-diameter part 21 of the length of N is surrounded by the large-diameter part 20 of the length of rank N+1.

The large-diameter part 20 and the small-diameter part 21 of a length are connected by a transition zone 22. The transition zone 22 can have a thickness similar to the thickness of the large-diameter part 20 and of the small-diameter part 21. The transition zone 22 may be substantially radial or substantially frustoconical. The communication tube 19 can be manufactured by a method including a step for roller-burnishing a metal foil thus forming the transition zone 22 and a step for shaping around a rigid mandrel having substantially the diameter of the communication cable 18.

Viewed from the outside (see the bottom of FIG. 3), the communication tube 19 has an outer surface formed by the large-diameter parts 20 of each length and also a portion of the transition zone 22, the non-visible part of which is overlapped by the large-diameter part 20 of the following length. The communication cable 18 is therefore overlapped by the communication tube 19 forming a shield. Its helical structure allows the communication tube 19 to be easily stretched resiliently. The resilient stretching of the communication tube 19 can be expressed as a percentage of its length, which is for example greater than 2%. This degree of resilient stretching is very much higher than the degree of resilient stretching of the body of the pipe 7. Thus, if the pipe 7 undergoes a high tensile stress causing elongation, the communication tube 19 can accompany said elongation, in the resilient range. The communication tube 19 can also easily contract resiliently under the influence of compressive loading. This merely requires the axial play between two consecutive lengths to be sufficient to accommodate the local contraction. The total contraction that the communication tube 19 can accommodate is equal to said axial play multiplied by the number of lengths. The axial play between each length of the turns may be much reduced, that is typically of the order of the pitch of a helical spiral divided by 200 in the case of a component made of steel. For example, if the pitch of a helical spiral is equal to 20 mm, the axial play between the lengths of the helical spiral could be of the order of 0.1 mm. In the case of a component made of a material that is softer than steel, this play could be increased so as to compensate the greater deformability of the component, typically within the same proportions as the ratio between the Young's modulus of steel and that of the alternative material.

As the lengths of the communication tube 19 have a wide overlap, of the order of 25 to 50% of the length of a length, the communication tube overlaps and protects the communication cable 19 even in a resiliently elongated state. The risk of the communication tube 19 breaking under the effect of excessive elongation during operation, of vibrations, of compression, etc. is extremely low. The communication tube 19 can have an external diameter of the order of 4 to 10 mm. The communication tube 19 occupies a small part of the flow section provided by the tubular body 9 of the pipe 7. The flow of the drilling mud is not significantly impeded.

Figure 4:
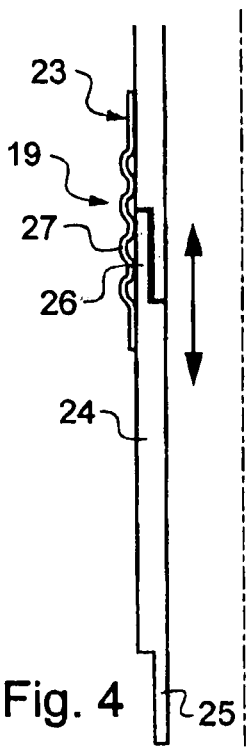
FIG. 4 is an axial section of a communication tube.

In the embodiment illustrated in FIG. 4, the communication tube 19 comprises a plurality of rings 23 partially overlapping one another. A ring 23 or sleeve comprises a thick central part 24, a first end part 25 comprising an outer surface having a smaller diameter than the outer surface of the central part 24 and a bore substantially in the extension of the bore of the central part 24 and a second end part 26 opposite to the end part 25 and having an outer surface substantially in the extension of the outer surface of the central part 24 and a bore having a diameter larger than the diameter of the bore of the central part 24. The diameter of the bore of the second end part 26 is larger than or equal to the diameter of the outer surface of the first end part 25, thus allowing nesting and overlapping of an end of one ring 23 by the corresponding end of a following ring 23.

The axial play is once more typically of the order of the length of a ring 23 divided by 200. For example, if the length of the ring 23 is equal to 200 mm, the axial play should be of the order of 1 mm.

In one embodiment, the outer surface of the end part 25 is substantially cylindrical. The bore of the second end part 26 may also be cylindrical. In order to promote a certain angular displacement between the axes of two successive rings, provision may be made for one or both contacting surfaces to be slightly dished.

The rings 23 can be made of steel. The communication tube 19 can thus be elongated while at the same time preserving its function for protecting the communication cable 18.

In a variation, the bore of the second end part 26 has a diameter larger than the diameter of the outer surface of the first end part 25 and the free ends of said parts 25 and 26 are slightly turned down toward the outside and toward the inside, respectively, holding one another by diametral interference beyond a relative movement over a predetermined distance of the ring 23.

In order to improve the tightness of the communication tube 19 and to provide a flexible connection between two neighbouring rings 23, the communication tube 19 is in this case equipped with a gusset 27. The gusset 27 is resilient. The gusset 27 can be made of synthetic material, of rubber, or else of a resilient metal alloy. The gusset 27 has a thickness which is much smaller than the thickness of a ring 23. The gusset 27 is fitted onto the outer surface of the central part 24 of one ring 23 and onto the outer surface of the central part 24 of another neighbouring ring 23. The gusset 27 overlaps the junction zone between two rings 23 while at the same time axially holding them. The rings are held radially relative to one another by the mutual overlap of the end parts 25 and 26 of the two neighbouring rings 23.

Figure 5:
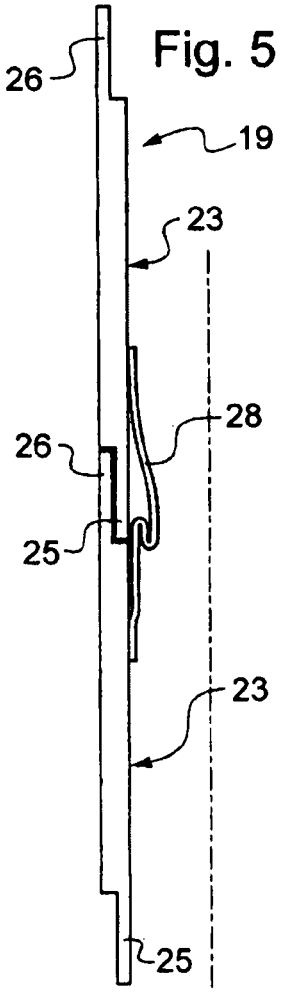
FIG. 5 is an axial section of a communication tube.

In the embodiment of FIG. 5, the rings 23 have a structure similar to that of the embodiment illustrated in FIG. 4. The gusset 28 is arranged in the bore of the central parts 24 of two neighbouring rings 23. The gusset 28 is thus less exposed to the abrasion caused by the drilling mud. The gusset 28 can more easily be made of an inexpensive and highly resilient material while at the same time providing a satisfactory useful life owing to its reduced exposure to abrasion.

The folds of the gusset 27 from FIG. 4 extend radially, whereas those of the gusset 28 from FIG. 5 extend axially. It is possible to use gussets having axial folds on the outer surface of the communication tube 19 and gussets having radial folds in the bore of this tube. Gussets without initial folds are also contemplated, if the material from which they are made is sufficiently flexible.

In a variation (not shown) of FIGS. 4 and 5, the central part of the rings can have substantially the same thickness as the end parts and be connected thereto by substantially radial or frustoconical transition parts. The diameters of the outer surface and the bore of the communication tube 19 are therefore not constant over the length of the communication tube 19.

Thus, a tubular drill string component can comprise a female end, a male end and a central tubular part connecting the female end and the male end with an armoured communication conduit arranged in the central tubular part. The armoured conduit comprises a body formed with at least one annular component and comprising, in section along a plane passing through the axis of the conduit (typically the communication tube), at least two axially elongated lengths which partially overlap one another with an axial play selected so as to accommodate the maximum elastic deformation of the component under axial compressive and/or bending stress.

Each length can comprise, in section along a plane passing through the axis of the conduit, a large-diameter part and a small-diameter part, both of which are elongated axially. The large-diameter part can surround a small-diameter part of a neighbouring length. The inner surfaces of the small-diameter parts form the bore of the conduit. The large-diameter part can surround the neighbouring small-diameter part with mutual contact. The communication tube (conduit) may be in the form of a metal strip arranged in helical turns. The communication tube may be in the form of a metal strip arranged in a ring arrangement, the tube comprising a plurality of nesting annular elements. Each annular element can comprise a central part, one end part having a large-diameter bore and another end part having a small-diameter outer surface. The thickness of the strip may be between 0.1 and 3 mm. The large-diameter part and the small-diameter part can have substantially equal axial dimensions.

The communication tube can comprise a flexible layer arranged in the tube in contact with its bore. The flexible layer can take the shape of a gusset, such as illustrated, for example, in FIGS. 4 and 5.

The communication tube can comprise a flexible layer arranged around its outer surface. The flexible layer can have folds extending radially or axially.

The mutual partial overlap of the lengths can be greater than the maximum elastic deformation of the component under axial compressive and/or bending stress.

The communication tube can be arranged longitudinally or helically against the bore of the central part of the tubular drilling component.

It is thus possible to construct a drill string comprising a body (typically a drill pipe section) and a bottom hole assembly provided with a drill bit. The body is arranged between the bottom hole assembly and a means for driving the string, said body comprising tubular components described hereinbefore.

The invention claimed is:

1. A tubular drill string component for drilling a hole with circulation of a drilling fluid around said component and in a direction going from a drill hole bottom to the surface, said component comprising:

a first end including a female threading;

a second end including a male threading, a groove that forms a recess for a coupler, and a through-hole, the through-hole emerging on a first side of the second end in a bottom of the groove and emerging on a second side of the second end in a connection surface;

a tubular central zone, the connection surface located between the second end and the tubular central zone;

a communication tube extending through the through-hole, arranged at least in the central zone and in contact with a bore of the central zone, and fixed by fitting in a widened zone of the through-hole, the widened zone adjacent to the connection surface, the communication tube includes a body formed from a plurality of metal strips arranged with an annular component, the body including, in section along a plane passing through the axis of the tube, at least a first axially elongated length and a second axially elongated length, the first and the second axially elongated lengths partially overlapping one another with an axial play selected to accommodate the maximum elastic deformation of the component under axial compressive and/or bending stress;

a signal transmission cable arranged in the tube; and a flexible gusset fitted to at least a first metal strip and a neighboring second metal strip of the plurality of strips so as to overlap a junction between the first metal strip and the second metal strip.

2. A component according to claim 1, wherein each length comprises, in section along a plane passing through the axis of the tube, a large-diameter part and a small-diameter part, the large-diameter part and the small-diameter part being elongated axially, the large-diameter part surrounding a small-diameter part of a neighboring length in such a way that the inner surfaces of the small-diameter parts form the bore of the tube.

3. A component according to claim 2, wherein the large-diameter part surrounds a neighboring small-diameter part with mutual contact.

4. A component according to one of claim 2, wherein the large-diameter part and the small-diameter part have equal axial dimensions.

5. A component according to claim 1, wherein the metal strip is arranged in helical turns.

6. A component according to claim 1, wherein the metal strip is arranged in a ring, the tube comprising a plurality of nesting annular elements.

7. A component according to claim 1, wherein the thickness of the strip is between 0.1 and 3 mm.

8. A component according to claim 1, wherein the gusset is arranged within the communication tube in contact with the bore of the tube.

9. A component according to claim 1, wherein the gusset is arranged around an outer surface of the communication tube, and the gusset has folds extending radially or axially.

10. A component according to claim 1, wherein the mutual partial overlap of the lengths is greater than the maximum elastic deformation of the component under axial compressive and/or bending stresses.

11. A drill string comprising:

a body; and a bottom hole assembly, the bottom hole assembly being provided with a drill bit, the body being arranged between the bottom hole assembly and a means for driving the string, the body including a component according to claim 1.

12. A component according to claim 1, wherein the signal transmission cable is overlapped by the communication tube forming a shield.

13. A component according to claim 1, wherein the communication tube consists of the body formed from at least one metallic strip.

14. A component according to claim 1, wherein the gusset is made of one of synthetic material, rubber or resilient metal alloy.

15. A tubular drill string component for drilling a hole with circulation of a drilling fluid around said component and in a direction going from a drill hole bottom to the surface, said component comprising:

a first end including a female threading;

a second end including a male threading, a groove that forms a recess for a coupler, and a through-hole, the through-hole emerging on a first side of the second end in a bottom of the groove and emerging on a second side of the second end in a connection surface;

a tubular central zone, the connection surface located between the second end and the tubular central zone;

a communication tube extending through the through-hole, arranged at least in the central zone and in contact with a bore of the central zone, and fixed by fitting in a widened zone of the through-hole, the widened zone adjacent to the connection surface, the communication tube includes a body formed from a plurality of rings partially overlapping one another, each ring includes a central part, a first end part having an outer surface with a diameter smaller than a diameter of an outer surface of the central part, and a second end part opposite the first end part and having an outer diameter a same size as the central part, wherein a first end part of a first ring overlaps with a second end part of a neighboring ring to thereby provide axial play to accommodate a maximum elastic deformation of the component under axial compressive and/or bending stress;

a signal transmission cable arranged in the tube; and a flexible gusset fitted onto each of one or more neighboring rings of the plurality of rings, the flexible gusset being fitted onto the central part of each of the neighboring rings and overlapping a junction between the neighboring rings.

16. A component according to claim 15, wherein the flexible gusset is arranged around an outer surface of the communication tube.

17. A component according to claim 15, wherein the flexible gusset is arranged within bores of the neighboring rings.

18. A component according to claim 15, wherein the flexible gusset has folds extending radially or axially.

19. A component according to claim 18, wherein an inner surface of the folds is spaced apart from the outer surface of the central part.

* * * * *